US010965040B2

(12) United States Patent
Tsai et al.

(10) Patent No.: US 10,965,040 B2
(45) Date of Patent: Mar. 30, 2021

(54) ANTENNA DEVICE

(71) Applicant: InnoLux Corporation, Miao-Li County (TW)

(72) Inventors: Tsung-Han Tsai, Miao-Li County (TW); Kuan-Feng Lee, Miao-Li County (TW); Yuan-Lin Wu, Miao-Li County (TW)

(73) Assignee: INNOLUX CORPORATION, Miao-Li County (TW)

( * ) Notice: Subject to any disclaimer, the term of this patent is extended or adjusted under 35 U.S.C. 154(b) by 297 days.

(21) Appl. No.: 15/987,116

(22) Filed: May 23, 2018

(65) Prior Publication Data

US 2019/0363450 A1 Nov. 28, 2019

(51) Int. Cl.

| | |
|---|---|
| ***H01Q 23/00*** | (2006.01) |
| ***H01Q 21/00*** | (2006.01) |
| ***H01Q 3/46*** | (2006.01) |
| ***H01Q 13/28*** | (2006.01) |
| ***H01Q 21/24*** | (2006.01) |

(52) U.S. Cl.

CPC ..... *H01Q 23/00* (2013.01); *H01Q 3/46* (2013.01); *H01Q 13/28* (2013.01); *H01Q 21/005* (2013.01); *H01Q 21/0006* (2013.01); *H01Q 21/0087* (2013.01); *H01Q 21/24* (2013.01)

(58) Field of Classification Search

CPC ..... H01Q 21/0006; H01Q 21/0012; H01Q 21/0037; H01Q 21/0043; H01Q 21/005; H01Q 21/06; H01Q 21/061; H01Q 21/065; H01Q 21/24; H01Q 21/245; H01Q 3/00; H01Q 3/44; H01Q 3/46; H01Q 3/443; H01Q 13/20; H01Q 13/28; H01Q 23/00; H01Q 21/0087; H01Q 21/064; H01Q 21/068; B81B 7/02; B81B 7/04; B81C 1/00158

See application file for complete search history.

(56) References Cited

U.S. PATENT DOCUMENTS

2017/0301475 A1 10/2017 Stevenson et al.
2017/0302004 A1* 10/2017 Stevenson ..... H01Q 21/065

* cited by examiner

*Primary Examiner* — Robert Karacsony
(74) *Attorney, Agent, or Firm* — McClure, Qualey & Rodack, LLP

(57) ABSTRACT

An antenna device is provided. The antenna device includes a first antenna pair. The first antenna pair includes a first antenna unit and a second antenna unit arranged juxtaposed to the first antenna unit. The first antenna unit includes a first membrane extending in a first longitudinal direction. The second antenna unit includes a second membrane extending in a second longitudinal direction. An angle between the first longitudinal direction and the second longitudinal direction is in a range from 75 to 105 degrees.

18 Claims, 10 Drawing Sheets

ANTENNA DEVICE

BACKGROUND

Technical Field

The present disclosure relates to an antenna device, and in particular to an antenna array that includes microelectromechanical system-based (MEMS-based) antenna units.

Description of the Related Art

Electronic products that include a display panel, such as smartphones, tablets, notebooks, monitors, and TVs, have become indispensable necessities in modern society. With the flourishing development of such portable electronic products, consumers have high expectations regarding the quality, functionality, and price of such products. These electronic products are often provided with communications capabilities.

Antennas are used extensively in the communications functionality of electronic products and are essential components of all radio equipment. Most existing antennas include resonators. Liquid-crystal molecules have recently been used as tuning elements in radio-frequency resonators. Specifically, a liquid-crystal antenna device can generate different dielectric coefficients by adjusting the electric field to control the rotation direction of the liquid-crystal molecules, and therefore adjust the phase, amplitude or propagation direction of the electromagnetic wave.

However, some difficulties may be encountered through the use of liquid-crystal molecules in antenna devices. For example, liquid-crystal molecules may be limited by the speed at which they can be switched, their operable temperature ranges, long-term reliability, and so on. Accordingly, it is desirable to develop an antenna structure that employs other reliable tuning elements.

SUMMARY

In accordance with some embodiments of the present disclosure, an antenna device is provided. The antenna device includes a first antenna pair. The first antenna pair includes a first antenna unit and a second antenna unit arranged juxtaposedly to the first antenna unit. The first antenna unit includes a first membrane extending in a first longitudinal direction. The second antenna unit includes a second membrane extending in a second longitudinal direction. The angle between the first longitudinal direction and the second longitudinal direction is in a range from 75 to 105 degrees.

In accordance with some embodiments of the present disclosure, an antenna device is provided. The antenna device includes a plurality of first antenna pairs and a waveguide disposed at one side of the plurality of first antenna pairs. Each of the plurality of first antenna pairs includes a first antenna unit and a second antenna unit arranged juxtaposedly to the first antenna unit. The first antenna unit includes a first membrane extending in a first longitudinal direction. The second antenna unit includes a second membrane extending in a second longitudinal direction. The angle between the first longitudinal direction and the second longitudinal direction is in a range from 75 to 105 degrees.

A detailed description is given in the following embodiments with reference to the accompanying drawings.

BRIEF DESCRIPTION OF THE DRAWINGS

The disclosure may be more fully understood by reading the subsequent detailed description and examples with references made to the accompanying drawings, wherein.

DETAILED DESCRIPTION

Figure 1:
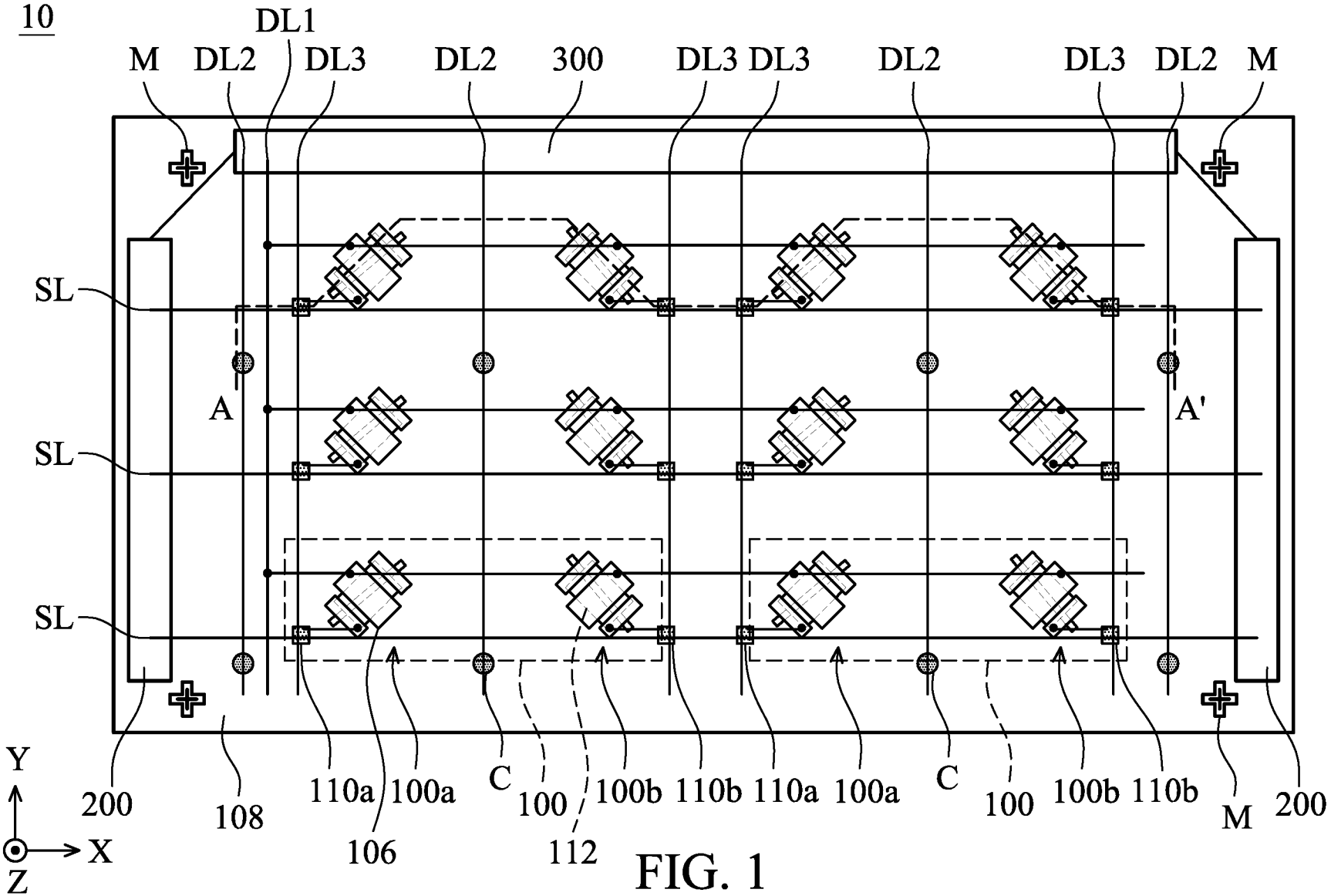
FIG. 1 illustrates a top view of the antenna device in accordance with some embodiments of the present disclosure.

The antenna device of the present disclosure and the manufacturing method thereof are described in detail in the following description. In the following detailed description, for purposes of explanation, numerous specific details and embodiments are set forth in order to provide a thorough understanding of the present disclosure. It will be apparent, however, that the exemplary embodiments set forth herein are used merely for the purpose of illustration, and the inventive concept may be embodied in various forms without being limited to those exemplary embodiments. In addition, the drawings of different embodiments may use like and/or corresponding numerals to denote like and/or corresponding elements. However, the use of like and/or corresponding numerals in the drawings of different embodiments does not suggest any correlation between different embodiments. In addition, in this specification, expressions such as "first material layer disposed above/on/over a second material layer", may indicate the direct contact of the first material layer and the second material layer, or it may indicate a non-contact state with one or more intermediate layers between the first material layer and the second material layer. In the above situation, the first material layer may not be in direct contact with the second material layer.

In addition, in this specification, relative expressions are used. For example, "bottom" or "top" is used to describe the position of one element relative to another. It should be appreciated that if a device is flipped upside down, an element that is "bottom" will become an element that is "top".

It should be understood that, although the terms first, second, third etc. may be used herein to describe various elements, components, regions, layers, portions and/or sections, these elements, components, regions, layers, portions and/or sections should not be limited by these terms. These terms are only used to distinguish one element, component, region, layer, portion or section from another element, component, region, layer or section. Thus, a first element, component, region, layer, portion or section discussed below could be termed a second element, component, region, layer, portion or section without departing from the teachings of the present disclosure.

It should be understood that this description of the exemplary embodiments is intended to be read in connection with the accompanying drawings, which are to be considered part of the entire written description. The drawings are not drawn to scale. In addition, structures and devices are shown schematically in order to simplify the drawing.

The terms "about" and "substantially" typically mean +/−20% of the stated value, more typically +/−10% of the stated value, more typically +/−5% of the stated value, more typically +/−3% of the stated value, more typically +/−2% of the stated value, more typically +/−1% of the stated value and even more typically +/−0.5% of the stated value. The stated value of the present disclosure is an approximate value. When there is no specific description, the stated value includes the meaning of "about" or "substantially".

Unless defined otherwise, all technical and scientific terms used herein have the same meaning as commonly understood by one of ordinary skill in the art to which this disclosure belongs. It should be appreciated that, in each case, the term, which is defined in a commonly used dictionary, should be interpreted as having a meaning that conforms to the relative skills of the present disclosure and the background or the context of the present disclosure, and should not be interpreted in an idealized or overly formal manner unless so defined.

In addition, in some embodiments of the present disclosure, terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

In addition, the term "longitudinal direction" is defined as the direction along or parallel to the long axis of an object. The long axis is defined as a line extending through the center of an object lengthwise. For an elongated or oblong object, the long axis corresponds most nearly to its greatest dimension lengthwise. For an object that does not have a definite long axis, the long axis is referred to the long axis of a minimum rectangle that can encircle the object.

In addition, the phrase "in a range from a first value to a second value" indicates the range includes the first value, the second value, and other values between them.

In accordance with some embodiments of the present disclosure, an antenna device is provided. The antenna device includes the antenna units that employ the structure of microelectromechanical system. In addition, the antenna units are arranged in a specific manner so that the electromagnetic wave generated by the antenna device may be substantially circular-polarized. Thus, the signal quality provided by the antenna device may be improved. With such a configuration, the antenna device may be more energy-saving. The antenna device may transmit or receive signals in multiple directions with better signal uniformity.

FIG. 1 illustrates a top view of the antenna device 10 in accordance with some embodiments of the present disclosure. It should be understood that some of the components of the antenna device 10 such as a first substrate 102 (the top substrate) are omitted in FIG. 1 for clarity. It also should be understood that additional features may be added to the antenna device in accordance with some embodiments of the present disclosure. Some of the features described below may be replaced or eliminated in accordance with some embodiments of the present disclosure.

Figure 4A:
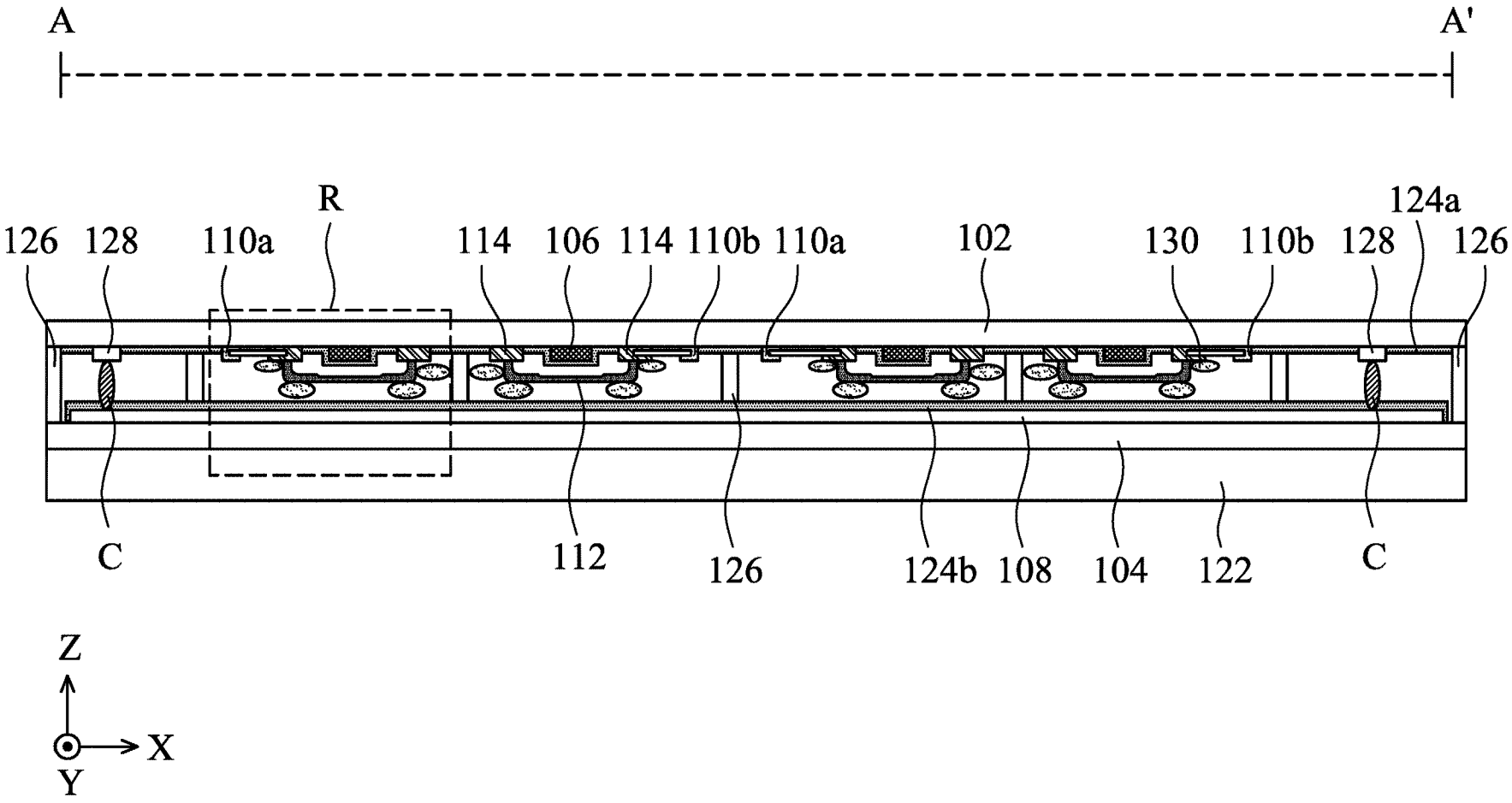
FIG. 4A illustrates a cross-sectional view of the antenna device along the line segment A-A' in FIG. 1.

Referring to FIG. 1, the antenna device 10 includes a plurality of antenna pairs 100. Each of the antenna pairs 100 may further include two antenna units, e.g., a first antenna unit 100*a* and a second antenna unit 100*b*. The antenna pairs 100 are disposed between a first substrate 102 and a second substrate 104 (as shown in FIG. 4A). The antenna pairs 100 may be arranged on the first substrate 102 with several signal lines and controllers to form an antenna array. In some embodiments, the antenna pair 100 are electrically connected to a scan line SL, a data line DL1, a data line DL2 and a data line DL3. Specifically, the scan line SL may be electrically connected to the driving element (e.g., a first driving element 110*a* or a second driving element 110*b* shown in FIG. 1) of the antenna unit. The data line DL1, the data line DL2 and the data line DL3 may be electrically connected to a first electrode 106, a second electrode 108 and a membrane 112 of the antenna unit respectively.

In addition, the scan lines SL may be electrically connected to a first controller 200. The first controller 200 may serve as a row controller of the array. In some embodiments, the scan lines SL may be electrically connected to more than one first controllers 200, for example the scan lines SL may be electrically connected to two first controllers 200. In other words, the antenna device 10 may include a dual-side driving system to control the signal of scan lines SL. The dual-side driving system may reduce resistor-capacitor loading (RC loading) of the signal lines or signal distortion issue that may be caused by the one-side driving system. On the other hand, the data lines DL1, the data lines DL2 and the data lines DL3 may be electrically connected to a second controller 300. The second controller 300 may serve as a column controller of the array. The first controller 200 and the second controller 300 may transmit the signals to the antenna units or receive the signals from the antenna units and process the signals. In addition, the first controller 200 and the second controller 300 may be electrically connected to each other. The scan lines, the data lines and the controllers of the array as described above may adjust and control switch on/off of the antenna units.

In addition, as shown in FIG. 1, the data line DL2 for controlling the signal of the second electrode 108 is also connected to several conductive terminals C. The conductive terminal C may electrically connect the data line DL2 disposed on the first substrate 102 (as shown in FIG. 4A) to the second electrode 108 disposed on the second substrate 104 (as shown in FIG. 4A). The conductive terminals C may be disposed at the communication area or the non-communication area (as shown in FIG. 1) of the array.

On the other hand, an alignment mark M may be disposed on the second substrate 104 in the antenna device 10. In some embodiments, the first substrate 102 may also include a corresponding alignment mark M so that the first substrate 102 and the second substrate 104 (the second electrode 108) may be aligned when they are assembled. In some embodiments, the alignment mark M may be disposed near the corner of the second substrate 104 or the first substrate 102. In addition, more than one alignment marks M may be disposed. In some embodiments, the alignment mark M may be formed by using a patterning process. The patterning process may include a photolithography process or a screen printing process.

Figure 2B:
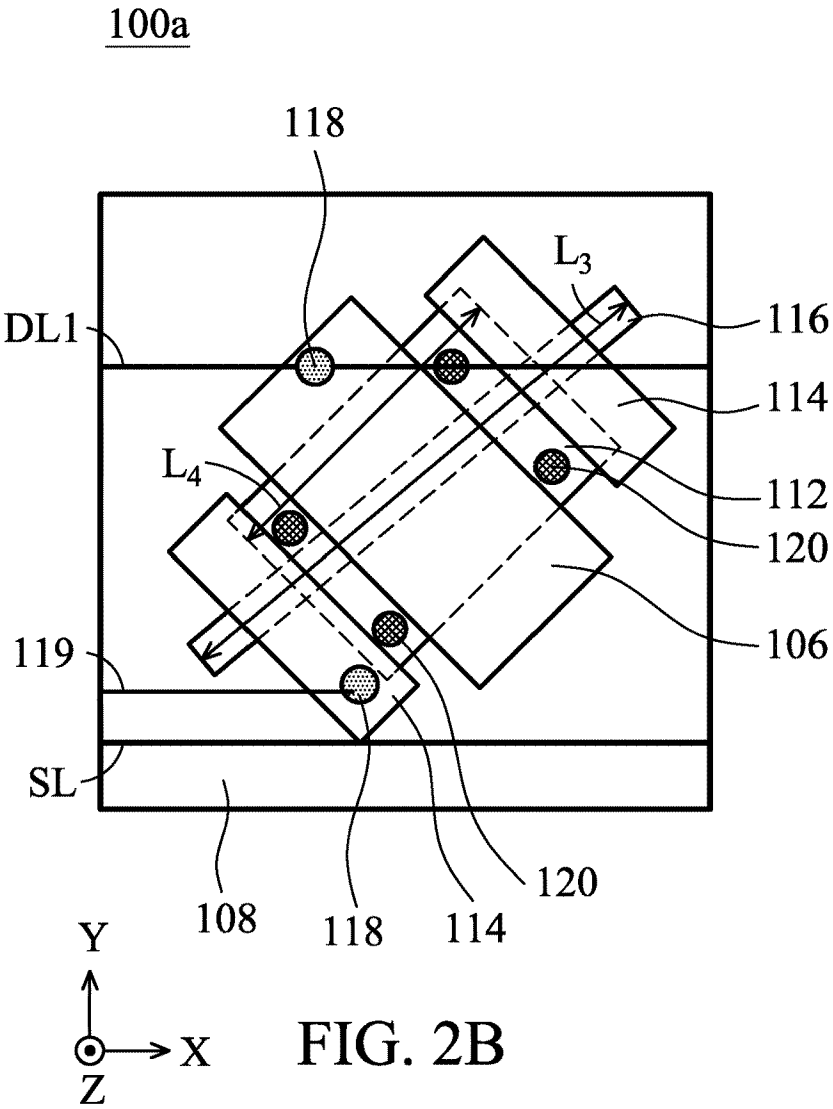
FIGS. 2A and 2B illustrate the enlarged top views of an antenna unit in the antenna device in accordance with some embodiments of the present disclosure.
Figure 2A:
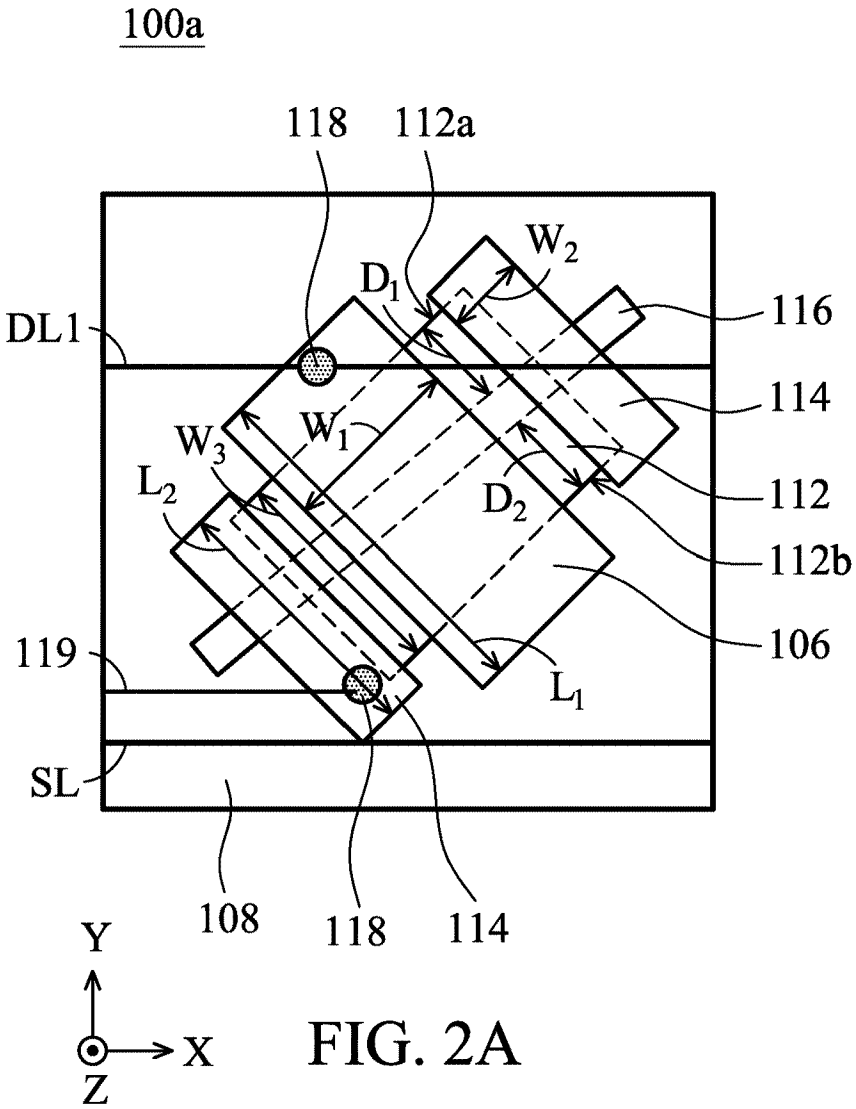

Next, referring to FIGS. 2A and 2B, FIGS. 2A and 2B illustrate the enlarged top views of an antenna unit 100*a* in the antenna device 10 in accordance with some embodiments of the present disclosure. As shown in FIG. 2A, the antenna unit 100*a* may include the first electrode 106, the membrane 112, and a first pad 114. The first electrode 106 and the second electrode 108 are disposed opposite each other. The first electrode 106 and the second electrode 108 may serve as the top electrode and the bottom electrode of the antenna unit 100*a* respectively. In some embodiments, the first electrode 106 may be electrically connected to the data line DL1 through a via 118.

The first electrode 106, the second electrode 108, and the first pad 114 may be made of conductive materials. In some embodiments, the first electrode 106, the second electrode 108 and the first pad 114 may each include, but are not limited to, copper, aluminum, molybdenum, tungsten, gold, chromium, nickel, platinum, titanium, copper alloys, aluminum alloys, molybdenum alloys, tungsten alloys, gold alloys, chromium alloys, nickel alloys, platinum alloys, titanium alloys, any other suitable conductive materials, or a combination thereof. In some embodiments, the first electrode 106, the second electrode 108 and the first pad 114 may be made of transparent conductive materials. For example, the first electrode 106, the second electrode 108 and the first pad 114 may each include, but are not limited to, indium tin oxide (ITO), tin oxide (SnO), indium zinc oxide (IZO), indium gallium zinc oxide (IGZO), indium tin zinc oxide (ITZO), any other suitable transparent conductive materials, or a combination thereof. In some embodiments, the first electrode 106, the second electrode 108 and the first pad 114 may be made of conductive polymers. For example, the conductive polymers include poly (3,4-ethylenedioxythiophene), polystyrene sulfonate (PEDOT:PSS), polythiophenes (PT), polypyrrole (PPY), or polyphenylene sulfide (PPS).

In some embodiments, the second electrode 108 further includes a slot 116 formed therein. The slot 116 may be a hollow region disposed in the second electrode 108. The slot 116 may be configured in a specific orientation to generate the electromagnetic wave with a desired direction. In some embodiments, the slot 116 may be disposed substantially parallel to the membrane 112. It should be understood that although the slot 116 has a rectangular shape shown in the figures, the slot 116 may have other suitable shapes in accordance with some other embodiments. Moreover, the slot 116 may be formed by using a patterning process. The patterning process may include a photolithography process or a screen printing process.

As shown in FIG. 2A, the membrane 112 may be disposed between the first electrode 106 and the second electrode 108. The membrane 112 may be in contact with the first pads 114. The antenna device 10 may include one or more first pads 114. In some embodiments, the membrane 112 is affixed on the first pads 114. Specifically, the membrane 112 may be disposed across the first electrode 106, which will be described in detail later. In addition, the membrane 112 may be electrically connected to the first driving element 110*a* (as shown in FIG. 1) through the first pad 114. In some embodiments, the first pad 114 may be electrically connected to the first driving element 110*a* through a conductive line 119 and a via 118.

The membrane 112 may be made of conductive materials. In some embodiments, the membrane 112 may be made of metallic materials. In some embodiments, the membrane 112 may include, but is not limited to, copper, aluminum, titanium, molybdenum, tantalum, tungsten, silver, gold, copper alloys, aluminum alloys, titanium alloys, molybdenum alloys, tantalum alloys, tungsten alloys, silver alloys, gold alloys, any other suitable metallic materials, or a combination thereof. The membrane 112 may be made of semiconductor materials such as silicon, germanium, or silicon carbide. The membrane 112 may also be made of conductive polymers described above.

As described above, the membrane 112 is disposed between the first electrode 106 and the second electrode 108. It should be noted that the position of the membrane 112 may be altered according to the changes of the electric potential between the membrane 112 and the first electrode 106 or between the membrane 112 and the second electrode 108. The voltage of the first electrode 106 may be different from the second electrode 108. Specifically, the voltage of the membrane 112 may be altered by controlling the first driving element 110*a* and the electrical potential difference between the membrane 112 and the first electrode 106 or the second electrode 108 may be altered. Therefore, the capacitance between the membrane 112 and the first electrode 106 or the second electrode 108 may be controlled. On the other hand, the voltage of the first electrode 106 may be controlled by the second controller 300 through the data line DL1. For example, when the electrical potential difference between the membrane 112 and the first electrode 106 increases, the membrane 112 may become closer to the first electrode 106, i.e. move toward the first electrode 106, and the capacitance between the membrane 112 and the first electrode 106 increases accordingly. On the contrary, when the first driving element 110*a* decreases the electrical potential difference between the membrane 112 and the first electrode 106, the membrane 112 may become farther away from the first electrode 106, i.e. move toward the second electrode 108, and the capacitance between the membrane 112 and the first electrode 106 decreases accordingly. Therefore, the capacitance of the antenna unit 100*a* may be adjusted by employing the microelectromechanical system-based structure as described above.

In addition, it should be noted that the first electrode 106 preferably have a size that is large enough so that the first electrode 106 can provide a sufficient electric field to control the movement of the membrane 112. For example, the first electrode 106 has a first width $W_1$ and a first length $L_1$. In some embodiments, the first width $W_1$ of the first electrode 106 is greater than a second width $W_2$ of the first pad 114. In some embodiments, the first length $L_1$ of the first electrode 106 is greater than a second length $L_2$ of the first pad 114. In some embodiments, the first length $L_1$ of the first electrode 106 is greater than a third width $W_3$ of the membrane 112. In addition, the size of the first pad 114 preferably be large enough to stably hold and affix the membrane 112. In some embodiments, the second length $L_2$ of the first pad 114 is greater than the third width $W_3$ of the membrane 112. Furthermore, the membrane 112 may overlap the slot 116. In some embodiments, the first distance $D_1$ is defined as the distance between the first side 112*a* of the membrane 112 and the slot 116, and the second distance $D_2$ is defined as the distance between the second side 112*b* of the membrane 112 and the slot 116. The above second side 112*b* is disposed opposite to the first side 112*a*. In some embodiments, the ratio of the first distance $D_1$ to the second distance $D_2$ is in a range from about 0.1 to about 10, or from about 0.5 to about 2. In addition, it should be understood that although the slot 116 has a third length $L_3$ that is greater than the fourth length $L_4$ of the membrane 112 shown in the figures (e.g., FIG. 2B), the slot 116 may have a length that is smaller than the fourth length $L_4$ of the membrane 112 in accordance with some other embodiments. In other words, the slot 116 may not protrude from the boundaries of the membrane 112.

In addition, as shown in FIG. 2B, the membrane 112 of the antenna unit 100*a* may further include at least one hole 120. The hole 120 may be generated due to a certain process of the manufacturing method, which will be described in detail later. In some embodiments, the holes 120 may be located outside the area of the first electrode 106. In other words, the holes 120 of the membrane 112 may not overlap the first electrode 106.

Figure 3:
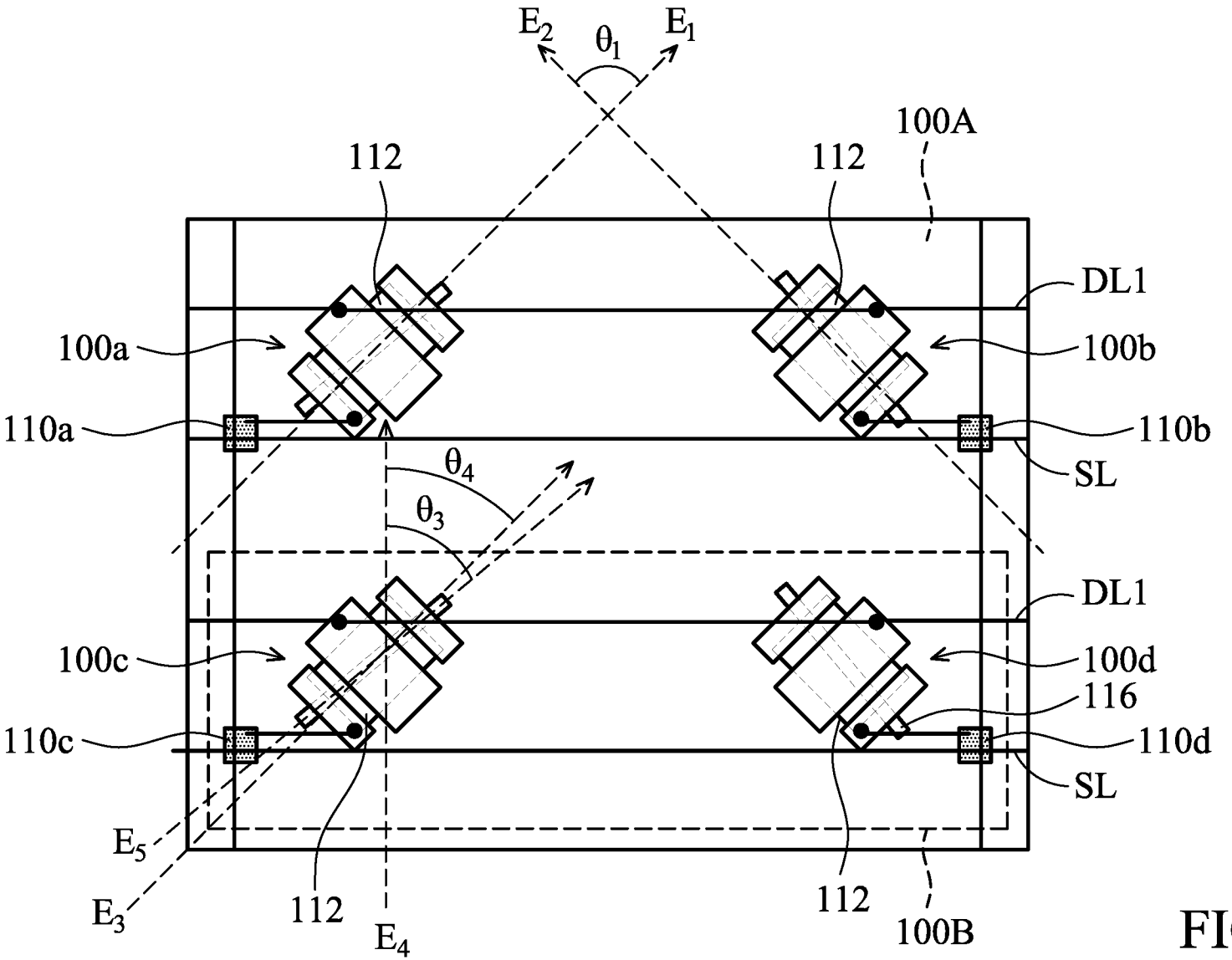
FIG. 3 illustrates a partially enlarged view of the antenna device of FIG. 1 in accordance with some embodiments of the present disclosure.

Next, referring to FIG. 3, FIG. 3 illustrates a partially enlarged view of the antenna device 10 of FIG. 1 in accordance with some embodiments of the present disclosure. The same or similar elements or layers in above and below contexts are represented by the same or similar reference numerals. The materials, manufacturing methods and functions of these elements or layers are the same or similar to those described above, and thus will not be repeated herein. FIG. 3 illustrates two antenna pairs 100, a first antenna pair 100A and a second antenna pair 100B, of the antenna device 10 to specify the configuration and arrangement of the antenna pairs and the antenna units. The first antenna pair 100A is disposed adjacent to the second antenna pair 100B. Specifically, the first antenna pair 100A and the second antenna pair 100B may be connected to different scan lines SL. In other words, the first antenna pair 100A and the second antenna pair 100B may be located at different rows of the array. The first antenna pair 100A includes the first antenna unit 100*a* and the second antenna unit 100*b* arranged juxtaposedly to the first antenna unit 100*a*. The second antenna pair 100B includes a third antenna unit 100*c* and a fourth antenna unit 100*d* arranged juxtaposedly to the third antenna unit 100*c*. As described above, the second antenna unit 100*b*, the third antenna unit 100*c* and the fourth antenna unit 100*d* may have the same or similar structure as that of the first antenna unit 100*a* as described in FIG. 2A.

As shown in FIG. 3, the membrane 112 of the first antenna unit 100*a* may extend in a first longitudinal direction $E_1$. The membrane 112 of the second antenna unit 100*b* may extend in a second longitudinal direction $E_2$. In some embodiments, an angle $\theta_1$ between the first longitudinal direction $E_1$ and the second longitudinal direction $E_2$ is in a range from about 75 degrees to about 105 degrees or from about 85 degrees to about 95 degrees.

In addition, the membrane 112 of the third antenna unit 100*c* may extend in a third longitudinal direction $E_3$. In some embodiments, an angle $\theta_2$ (not illustrated) between the third longitudinal direction $E_3$ and the first longitudinal direction $E_1$ is in a range from about 0 degree to about 15 degrees or from about 0 degree to about 5 degrees. In some embodiments, the third longitudinal direction $E_3$ may be substantially parallel to the first longitudinal direction $E_1$. In other words, the membrane 112 of the third antenna unit 100*c* may be substantially parallel to the membrane 112 of the first antenna unit 100*a*. In particular, the antenna units and the antenna pairs should be arranged in a specific orientation so that the electromagnetic wave generated from the antenna device 10 may be substantially circular-polarized. Thus, the signal quality provided by the antenna device 10 may be improved. In some embodiments, the antenna device 10 may receive or transmit signals of right-hand circular polarization (RHCP) or left-hand circular polarization (LHCP).

In addition, the antenna device 10 may further include a waveguide 122 (as shown in FIG. 4A) disposed at one side of the antenna pairs 100. Specifically, the waveguide 122 may be disposed below the second substrate 104. The membrane 112 may be disposed between the first electrode 106 and the waveguide 122. The waveguide 122 may provide a feed wave for the antenna device 10. The feed wave may radiate the electromagnetic wave through the slot 116 and the direction of the electromagnetic wave may be adjusted by the antenna units disposed over the slot 116. In some embodiments, the feed wave provided by the waveguide 122 may travel along a fourth longitudinal direction $E_4$. In some embodiments, an angle $\theta_3$ between the third longitudinal direction $E_3$ and the fourth longitudinal direction $E_4$ is in a range from about 30 degrees to about 60 degrees or from about 40 degrees to about 50 degrees. In addition, the slot 116 may extend in a fifth longitudinal direction $E_5$. In some embodiments, an angle $\theta_4$ between the fifth longitudinal direction $E_5$ and the fourth longitudinal direction $E_4$ is in a range from about 30 degrees to about 60 degrees or from about 40 degrees to about 50 degrees. In some embodiments, though not shown in the drawings, an angle between the third longitudinal direction $E_3$ and the fifth longitudinal direction $E_5$ is in a range from about 0 degree to 15 degrees. As shown in FIG. 3, the third longitudinal direction $E_3$ is not parallel to the fifth longitudinal direction $E_5$. In other words, for an antenna unit, an angle between a longitudinal direction of the slot and a longitudinal direction of the membrane is in a range from 0 degree to 15 degrees.

As shown in FIG. 3, the first antenna unit 100*a* and the second antenna unit 100*b* may be electrically connected to the first driving element 110*a* and the second driving element 110*b* respectively. Similarly, the third antenna unit 100*c* and the fourth antenna unit 100*d* may be electrically connected to the third driving element 110*c* and the fourth driving element 110*d* respectively. More specifically, the first driving element 110*a* and the second driving element 110*b* may be electrically connected to the membrane 112 of the first antenna unit 100*a* and the membrane 112 of the second antenna unit 100*b* respectively. The third driving element 110*c* and the fourth driving element 110*d* may be electrically connected to the membrane 112 of the third antenna unit 100*c* and the membrane 112 of the fourth antenna unit 100*d* respectively. As described above, the first antenna pair 100A and the second antenna pair 100B may be connected to different scan lines SL. In some embodiments, the first driving element 110*a* and the third driving element 110*c* may be activated sequentially. In some embodiments, the second driving element 110*b* and the fourth driving element 110*d* may be activated sequentially.

Next, referring to FIG. 4A, FIG. 4A illustrates a cross-sectional view of the antenna device 10 along the line segment A-A' in FIG. 1. Some of the components such as the signal lines SL the signal lines and so on are omitted to specify the structure of the antenna device 10. As shown in FIG. 4A, the antenna device 10 may include the waveguide 122 disposed at one side of the second substrate 104. In addition, the second electrode 108 may be disposed at the other side of the second substrate 104. The waveguide 122 and the second electrode 108 may be disposed on opposite sides of the second substrate 104. As described above, the first substrate 102 and the second substrate 104 may serve as the top substrate and the bottom substrate of the antenna device 10. The first electrode 106 and the second electrode 108 are disposed on the first substrate 102 and the second substrate 104 respectively. The first electrode 106 and the second electrode 108 are disposed opposite each other. In some embodiments, the first electrode 106 and the second electrode 108 may be biased by different voltages. In some embodiments, the first substrate 102 and the second substrate 104 each may include, but is not limited to, glass, quartz, sapphire, silicon (Si), germanium (Ge), polycarbonate (PC), polyimide (PI), polyethylene terephthalate (PET), rubbers, glass fibers, other polymer materials, any other suitable substrate material, or a combination thereof. In some embodiments, the second substrate 104 may be made of a wafer.

Moreover, the antenna device 10 may include the membrane 112 disposed across the first electrode 106. Specifically, as shown in FIG. 4A, the membrane 112 may have an overhang structure that overlaps the first electrode 106. In addition, the membrane 112 may be in contact with the first pads 114 disposed on the first substrate 102. The first pads 114 may electrically connect the membrane 112 with the driving elements (e.g., the first driving element 110*a* and the second driving element 110*b*) that is disposed on the first substrate 102. In some embodiments, the driving elements (the first driving element 110*a* and the second driving element 110*b*) may include at least one active driving element such as a thin-film transistor (TFT). In some other embodiments, the driving elements (the first driving element 110*a* and the second driving element 110*b*) may include a passive driving element. For example, the driving elements may be controlled by an IC or a microchip.

Furthermore, the antenna device 10 may further include the conductive terminals C disposed between the first substrate 102 and the second substrate 104. The conductive terminal C may electrically connect the first substrate 102 with the second substrate 104. In some embodiments, the conductive terminal C may transmit the signals between first substrate 102 and the second substrate 104. For example, the conductive terminal C may transmit the signals generated from the first substrate 102 to the second substrate 104. As described above, the conductive terminals C may be connected to the data line DL2.

The conductive terminals C may be made of conductive materials. In some embodiments, the conductive terminal C may include, but is not limited to, copper, aluminum, molybdenum, tungsten, gold, chromium, nickel, copper alloys, aluminum alloys, molybdenum alloys, tungsten alloys, gold alloys, chromium alloys, nickel alloys, any other suitable metallic materials, or a combination thereof.

In addition, the antenna device 10 may further include a first insulating layer 124*a* disposed over the first substrate 102 and a second insulating layer 124*b* disposed over the second electrode 108. The first insulating layer 124*a* may be disposed over the first electrode 106. In some embodiment, the first insulating layer 124*a* may partially or entirely expose the first pads 114 so that the first pads 114 may electrically connect to the membrane 112.

The first insulating layer 124*a* and the second insulating layer 124*b* may be made of insulating materials. In some embodiments, the first insulating layer 124*a* and the second insulating layer 124*b* each may include, but is not limited to, an organic material, an inorganic material or a combination thereof. The organic material may include, but is not limited to, an acrylic or methacrylic organic compound, isoprene compound, phenol-formaldehyde resin, benzocyclobutene (BCB), PECB (perfluorocyclobutane) or a combination thereof. The inorganic material may include, but is not limited to, silicon nitride, silicon oxide, or silicon oxynitride or a combination thereof.

As shown in FIG. 4A, the antenna device 10 may further include a spacer element 126 disposed between the first substrate 102 and the second substrate 104. The spacer elements 126 may be used to reinforce the structural strength of the antenna device 10. In some embodiments, the spacer elements 126 may extend along a direction that is substantially perpendicular to the first substrate 102 or the second substrate 104 (i.e. extend along the Z direction). In some embodiments, the spacer elements 126 may be a plurality of columnar structures arranged in parallel. In some other embodiments, the spacer elements 126 may have any other suitable shapes. Moreover, the spacer elements 126 may penetrate through the first insulating layer 124*a* and/or the second insulating layer 124*b* and in contact with the first substrate 102 and/or the second electrode 108. However, in some other embodiments, the spacer elements 126 may not penetrate through the first insulating layer 124*a* and the second insulating layer 124*b*. In other words, the spacer elements 126 may be not in contact with the first substrate 102 and the second electrode 108.

In addition, the spacer element 126 may be made of an insulating material or a conductive material. In some embodiments, the material of the spacer element 126 may include, but is not limited to, copper, silver, gold, copper alloys, silver alloys, gold alloys, or a combination thereof. In some embodiments, the spacer element 126 may include, but is not limited to, polyethylene terephthalate (PET), polyethylene (PE), polyethersulfone (PES), polycarbonate (PC), polymethylmethacrylate (PMMA), glass, any other suitable materials, or a combination thereof.

As shown in FIG. 4A, the conductive terminal C may be connect to the first substrate 102 additionally through a second pad 128 in accordance with some embodiments. In some embodiments, the second pads 128 may be partially or entirely exposed by the first insulating layer 124*a*. In addition, the second pad 128 may be made of conductive materials which are the same or similar to those described above.

In addition, the antenna device 10 may further include a filling material 130 disposed around the membrane 112. In some embodiments, the filling material 130 may be disposed in the antenna unit and in contact with the membrane 112. In some embodiments, the filling material 130 may be partially or entirely filled in the space defined between the first substrate 102 and the second substrate 104. The filling material 130 may provide mechanical lubrication for the membrane 112 to decrease abrasion. Therefore, the filling material 130 may be provided near a position where the membrane 112 connects to the first pads 114. Specifically, the filling material 130 may be applied to the membrane 112 so that the membrane 112 may not be broken easily due to the vibration. In some embodiments, the filling material 130 may be made of lubricants. In some embodiments, examples of the filling material 130 may include, but are not limited to, alkane, polyglycol, polyethylene glycol, polyether hydrocarbon, lipid, silicide, fluoride, any other suitable materials, or combinations thereof.

Furthermore, in some embodiments, the space between the first substrate 102 and the second substrate 104 may be filled with air, nitrogen or other suitable inert gas. Alternatively, the space between the first substrate 102 and the second substrate 104 may be vacuumed in accordance with some embodiment. Such a configuration may prevent the metallic materials disposed in the antenna device 10 from corrosion.

Figure 4B:
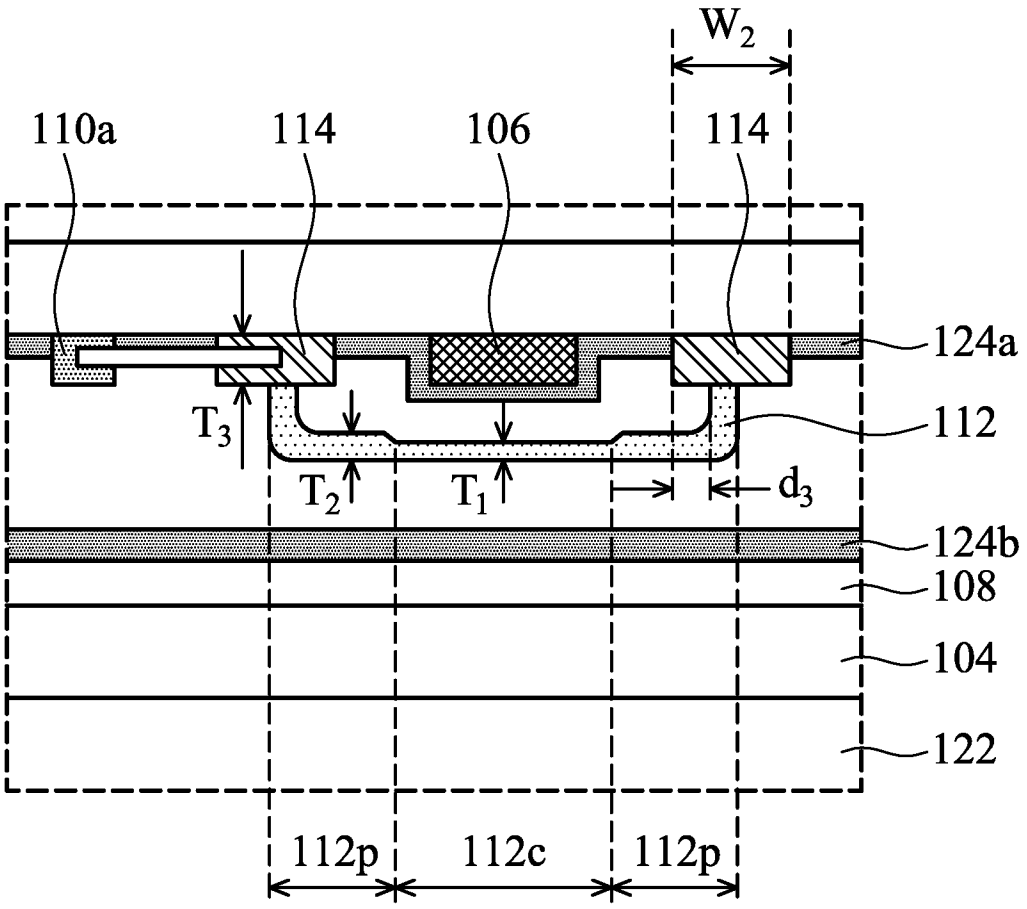
FIG. 4B illustrates a partially enlarged view of the region R in FIG. 4A in accordance with some embodiments of the present disclosure.

Next, referring to FIG. 4B, FIG. 4B illustrates a partially enlarged view of the region R in FIG. 4A in accordance with some embodiments of the present disclosure. As shown in FIG. 4B, the thickness of the membrane 112 may be not uniform. In some embodiments, the membrane 112 may be thinner at the central region that is substantially corresponding to the first electrode 106. Specifically, the membrane 112 may include a first portion 112*c* and second portions 112*p*.

The first portion 112*c* is farther away from the first pad 114 than the second portion 112*p*, and the first portion 112*c* overlaps the first electrode 106. In some embodiments, the first portion 112*c* partially or entirely overlaps the first electrode 106. In some embodiments, the first portion 112*c* of the membrane 112 has a first thickness $T_1$ and the second portion 112*p* of the membrane 112 has a second thickness $T_2$. In some embodiments, the thickness $T_2$ is greater than the thickness $T_1$. In addition, in some embodiments, the first pad 114 has a third thickness $T_3$. In some embodiments, the thickness $T_3$ is greater than the thickness $T_1$. In some embodiments, the thickness $T_3$ is greater than the thickness $T_2$. In particular, the thickness of the membrane 112 may be thinner at the central region so that the membrane 112 may vibrate more easily or efficiently. In addition, the first pad 114 has a certain thickness so that it may have stable mechanical strength to maintain the membrane 112.

As described above, the first pad 114 may have a second width $W_2$. In some embodiments, the third distance $d_3$ is defined as the distance between the membrane 112 and the edge of the first pad 114. In some embodiments, the third distance $d_3$ is greater than zero and less than or equal to 0.9 times of the second width $W_2$ ($0<d_3\leq 0.9*W_2$). With such a configuration, the membrane 112 will not be too close to the edge of the pads 114 so that electrostatic discharge (ESD) or corona discharge may be avoided, and tolerance to the manufacturing variation can be provided.

Figure 5A:
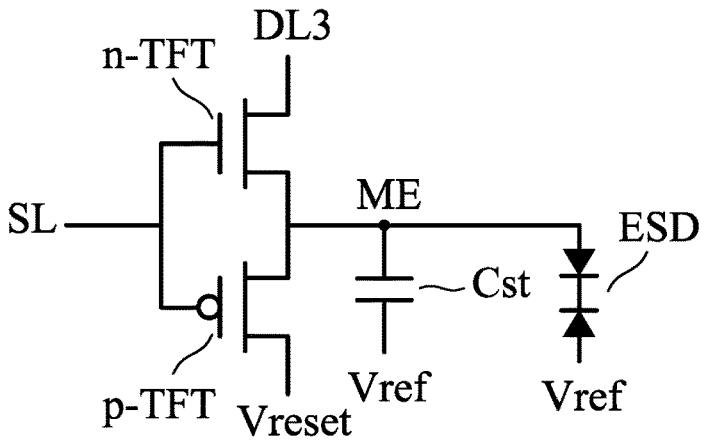
FIGS. 5A-5C illustrate the circuit diagrams of a membrane with a driving element in accordance with some embodiments of the present disclosure.
Figure 5B:
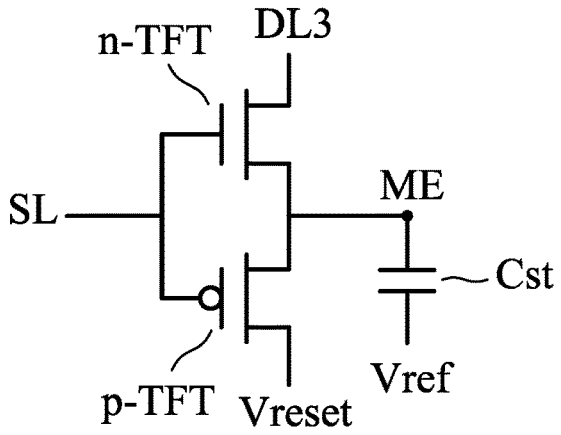
Figure 5C:
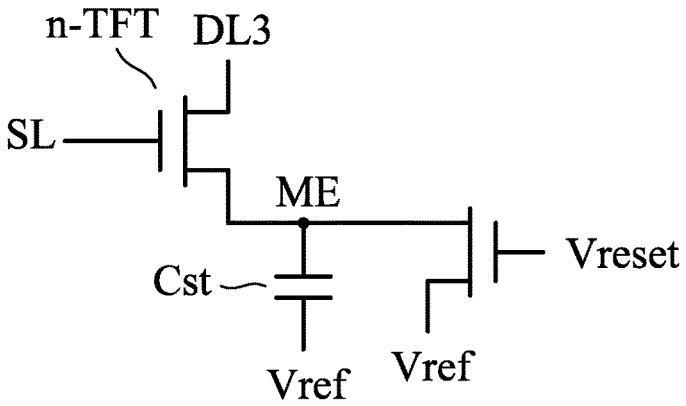

Next, referring to FIGS. 5A-5C, FIGS. 5A-5B illustrate the circuit diagrams of a membrane with a driving element in accordance with some embodiments of the present disclosure. As shown in FIGS. 5A and 5B, the antenna device 10 may be driven by a complementary metal-oxide-semiconductor (CMOS) structure. In addition, in some embodiments, as shown in FIG. 5A, an electrostatic discharge circuit such as diode may be electrically connected to an end ME of the membrane 112 so as to protect the membrane 112 from the electrostatic discharge (ESD). It should be noted that the circuit design of ESD diodes is not limited to those shown in the figures. In some embodiments, the driving circuit may include more than one ESD diodes. In some embodiments, the ESD diodes may be electrically connected to the first pads 114 of the antenna device 10. In addition, the complementary metal-oxide-semiconductor structure may be formed by low-temperature polysilicon, but it is not limited thereto. As shown in FIG. 5C, the antenna device 10 may be driven by a thin-film transistor (TFT) structure. The thin-film transistor structure may be a top gate thin-film transistor or a bottom gate thin-film transistor. In addition, another thin-film transistor may be electrically connected to an end ME of the membrane 112 so as to reset the voltage of the membrane. It should be noted that in FIGS. 5A-5C, the Vref refers to a reference voltage which can be set at a ground voltage or a preset voltage, and the Vreset refers to a reset voltage which can be set at a preset voltage. The Vref and the Vreset may be set at the same value or different values.

Next, referring to FIGS. 6A-6F, FIGS. 6A-6F illustrate the cross-sectional views of parts of the antenna device 10 formed in the intermediate stages of the manufacturing method in accordance with some embodiments of the present disclosure. Specifically, FIGS. 6A-6F illustrate forming processes of the top electrode 106, the first pads 114, the membrane 112 and so on of the antenna device 10. It should be understood that additional operations may be provided before, during, and after the processes of the manufacturing method of the antenna device 10 in some embodiments. In some embodiments, some of the operations described below may be replaced or eliminated. In some embodiments, the order of the operations/processes may be interchangeable.

Figure 6A:
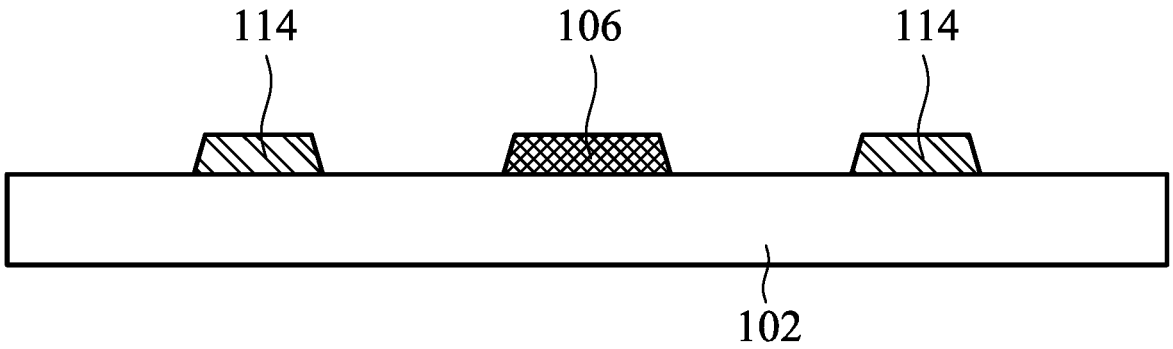
FIGS. 6A-6F illustrate the cross-sectional views of parts of the antenna device formed in the intermediate stages of the manufacturing method in accordance with some embodiments of the present disclosure.

Referring to FIG. 6A, the first electrode 106 and the first pads 114 may be formed over the first substrate 102. In some embodiments, the first electrode 106 and the first pads 114 may be formed at the same step or at the different steps. In some embodiments, the first electrode 106 and the first pad 114 may be formed by using chemical vapor deposition, physical vapor deposition, electroplating process, electroless plating process, any other suitable process, or a combination thereof. In addition, the first electrode 106 and the first pad 114 may be patterned by using a patterning process. The patterning process may include a photolithography process or a screen printing process. The photolithography process may include, but is not limited to, photoresist coating (e.g., spin coating), soft baking, hard baking, mask aligning, exposure, post-exposure baking, developing the photoresist, rinsing, drying, and other suitable processes. The etching process may include a dry etching process or a wet etching process.

Figure 6B:
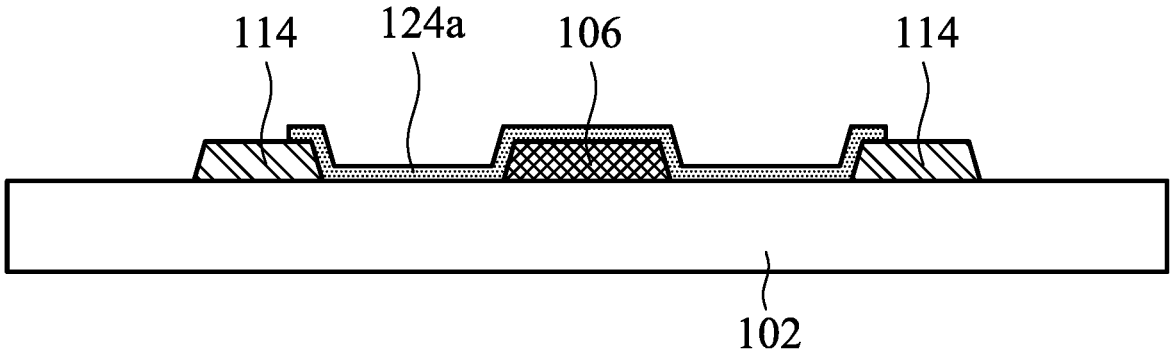

Next, referring to FIG. 6B, the first insulating layer 124*a* may be formed over the first electrode 106 and the first pads 114. Specifically, the first insulating layer 124*a* may entirely cover the first electrode 106. In some embodiments, the first insulating layer 124*a* may be conformally formed over the first electrode 106 and the first pads 114. In addition, in some embodiments, the first insulating layer 124*a* may partially cover the first pads 114. In some embodiments, an insulating material may be formed covering both the first electrode 106 and the first pads 114 and then a portion of the insulating material may be removed to form the first insulating layer 124*a*. In some embodiments, the first insulating layer 124*a* may have a multi-layered structure.

In some embodiments, first insulating layer 124*a* may be formed by using chemical vapor deposition, spin coating, any other suitable process, or a combination thereof. In addition, the first insulating layer 124*a* may be patterned by using a patterning process.

Figure 6C:
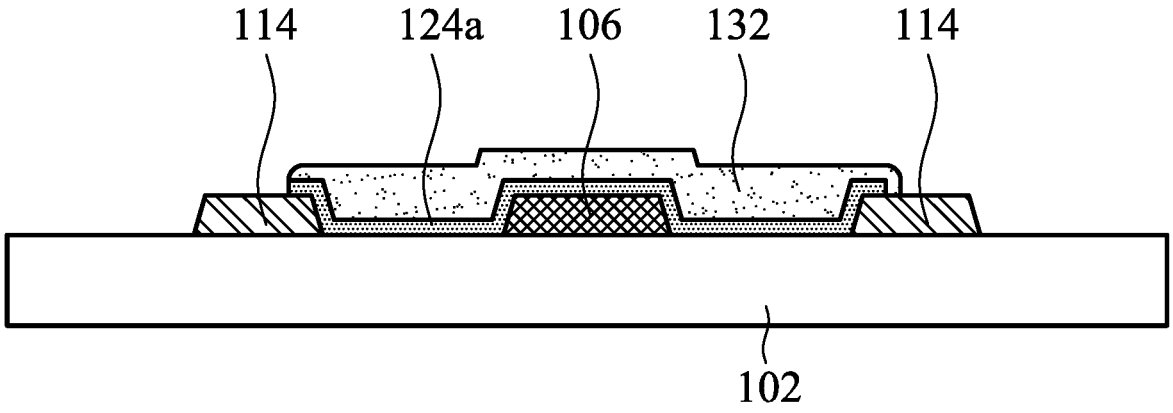

Next, referring to FIG. 6C, a sacrificial layer 132 may be formed over the first insulating layer 124*a*. In some embodiments, the sacrificial layer 132 may also cover a portion of the first pads 114 and contact the first pads 114. In some other embodiments, the sacrificial layer 132 may cover a portion of the first pads 114 while not contact the first pads 114, i.e. the edge of the sacrificial layer 132 may be substantially aligned with the edge of the first insulating layer 124*a*. In some embodiments, the sacrificial layer 132 may be in contact with the first pad 114 at one end while not in contact with the first pad 114 at the other end. The sacrificial layer 132 may be formed to assist in shaping the profile of the membrane 112 and would be removed after the formation of the membrane 112 is completed. In some embodiments, the sacrificial layer 132 has a protruding portion that corresponds to or covers the first electrode 106.

In some embodiments, the sacrificial layer 132 may include insulating materials, such as silicon oxides (SiOx), silicon nitrides (SiNx), silicon oxynitrides (SiON), aluminum oxides (AlOx), titanium oxides (TiOx), or a combination thereof. In some other embodiments, the sacrificial layer 132 may include, but is not limited to, polymer materials. In addition, in some embodiments, a sacrificial layer 132 may be formed by using chemical vapor deposition, spin coating, any other suitable process, or a combination thereof. The sacrificial layer 132 may be patterned by using a patterning process.

Figure 6D:
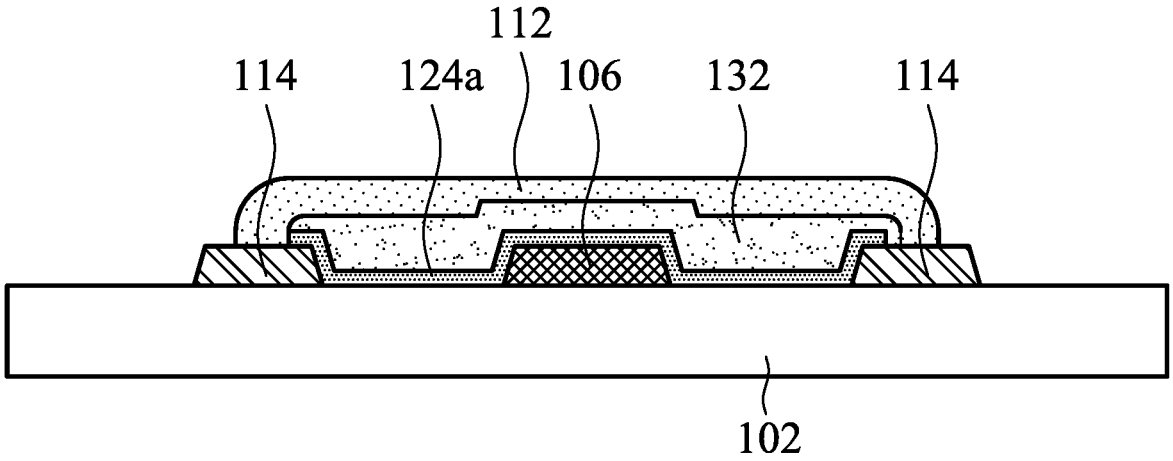

Next, referring to FIG. 6D, the membrane 112 may be formed over the sacrificial layer 132. The membrane 112 may cover the sacrificial layer 132 and in contact with the first pads 114 at both sides of the first electrode 106. In other words, the membrane 112 may disposed across the first electrode 106. In some embodiments, the membrane 112 may be in contact with the first insulating layer 124*a*. In some embodiments, the membrane 112 may be not in contact with the first insulating layer 124*a*, while the sacrificial layer 132 is disposed between the membrane 112 and the first insulating layer 124*a*. In some embodiments, the membrane 112 may be thinner at the region corresponding to the first electrode 106 due to the profile of the sacrificial layer 132.

In some embodiments, the membrane 112 may be formed by using chemical vapor deposition, physical vapor deposition, electroplating process, electroless plating process, any other suitable process, or a combination thereof. The membrane 112 may be patterned by using a patterning process. In some embodiments, the membrane 112 may have round corners near the regions where the membrane 112 connects to the first pads 114.

Figure 6E:
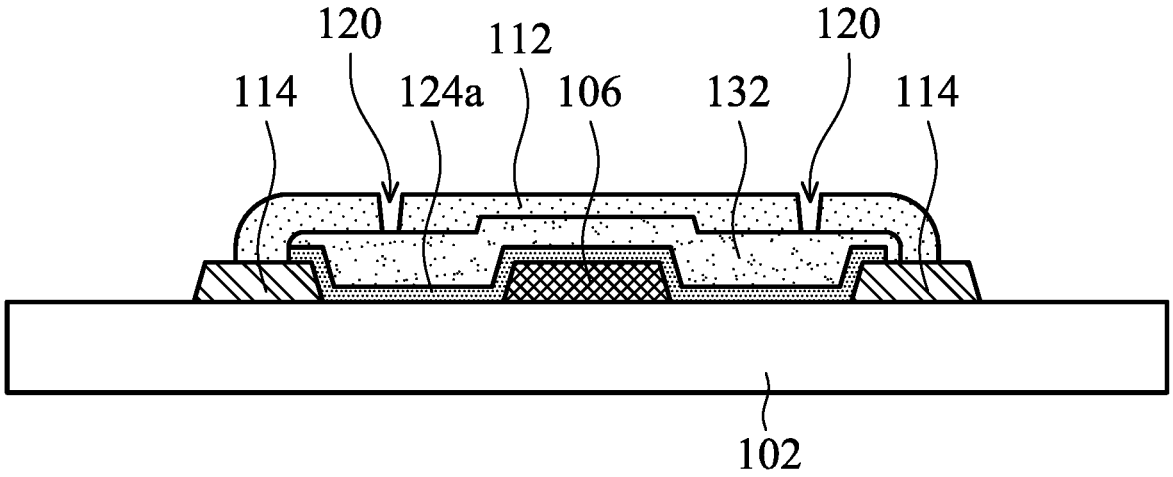

Next, referring to FIG. 6E, portions of the membrane 112 are removed to form the holes 120. The holes 120 may expose portions of the sacrificial layer 132. As described above, the holes 120 may be located outside the region that overlaps the first electrode 106. In other words, the holes 120 of the membrane 112 do not overlap the first electrode 106. The membrane 112 may include the holes 120 so that the sacrificial layer 132 may be easily removed. Moreover, as shown in FIG. 6E, the top portion of the holes 120 may be larger than the bottom portion of the holes 120. In some embodiments, the diameter of the hole 120 may be in a range from about 1 μm to about 100 μm. In some embodiments, the hole 120 may be formed by using a patterning process.

Figure 6F:
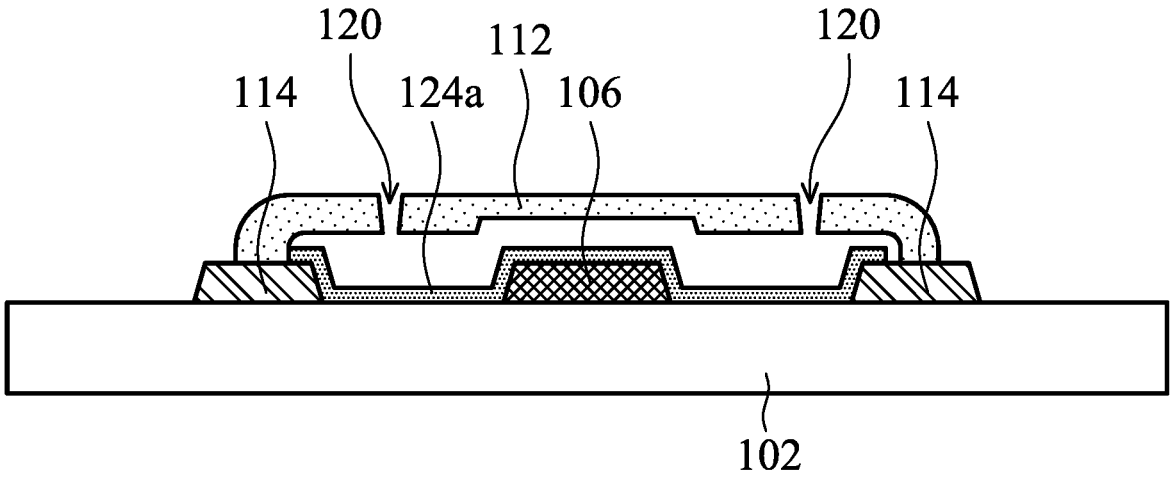

Next, referring to FIG. 6F, the sacrificial layer 132 may be removed after formation of the hole 120. The membrane 112 may have an overhang structure that overlaps the first electrode 106 after removal of the sacrificial layer 132. In some embodiments, the sacrificial layer 132 may be removed by using etching processes. The etching process may include a dry etching process or a wet etching process. In some embodiments, the etchant of the etching process may remove the sacrificial layer 132 through the holes.

More specifically, in the embodiments where the sacrificial layer 132 is formed of silicon oxides (SiOx), silicon nitrides (SiNx), silicon oxynitrides (SiON), aluminum oxides (AlOx), titanium oxides (TiOx), or a combination thereof, the etchant may include, but is not limited to, hydrofluoric acid (HF), $NH_4H$, or a combination thereof. In the embodiments where the sacrificial layer 132 is formed of polymer materials, the etchant may include, but is not limited to, KOH or other alkaline solutions.

Next, referring to FIGS. 7A-7D, FIGS. 7A-7D illustrate the cross-sectional views of parts of the antenna device 10 in accordance with some embodiments of the present disclosure. Specifically, FIGS. 7A-7D illustrate different configurations of the membrane 112. As shown FIG. 7A, in some embodiments, the membrane 112 may be a single layered structure. As described above, the membrane 112 may be made of conductive materials. In some embodiments, the membrane 112 may be made of metallic materials which are the same or similar to those described above.

Figure 7A:
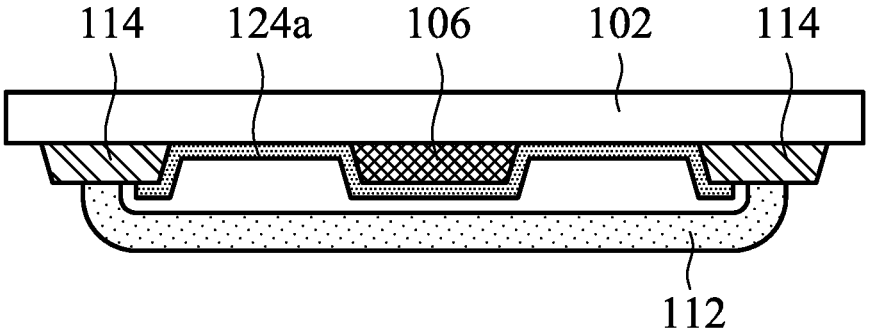
FIGS. 7A-7D illustrate the cross-sectional views of parts of the antenna device in accordance with some embodiments of the present disclosure.
Figure 7B:
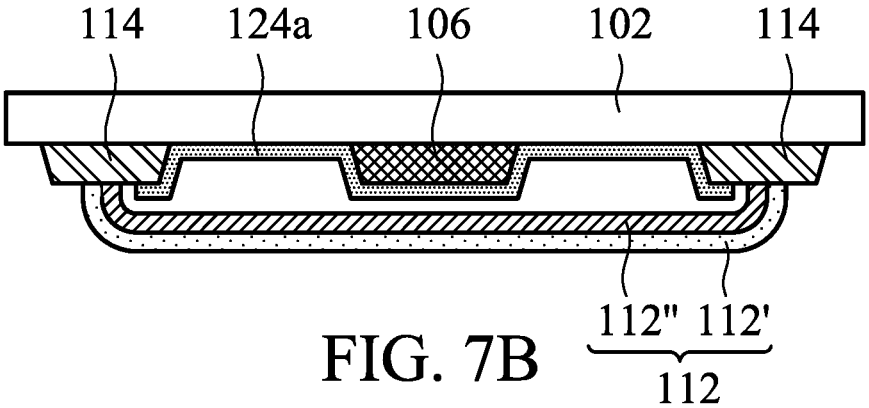

Next, referring to FIG. 7B, the membrane 112 may be a multi-layered structure. In some other embodiments, the membrane 112 may be formed of more than two layers. As shown in FIG. 7B, the membrane 112 may include a first layer 112' and the second layer 112". The first layer 112' may overlay the second layer 112". In some embodiments, the first layer 112' is disposed conformally over the second layer 112". In addition, in some embodiments, both the first layer 112' and the second layer 112" are in contact with the first pads 114.

In some embodiments, the first layer 112' and the second layer 112" may respectively be made of conductive materials and insulating materials. In some embodiments, the first layer 112' and the second layer 112" may respectively be made of insulating materials and conductive materials. In some embodiments, the conductive material may be any conductive material which is the same or similar to those described above. In some embodiments, the insulating material may be any insulating material which is the same or similar to those described above.

Figure 7C:
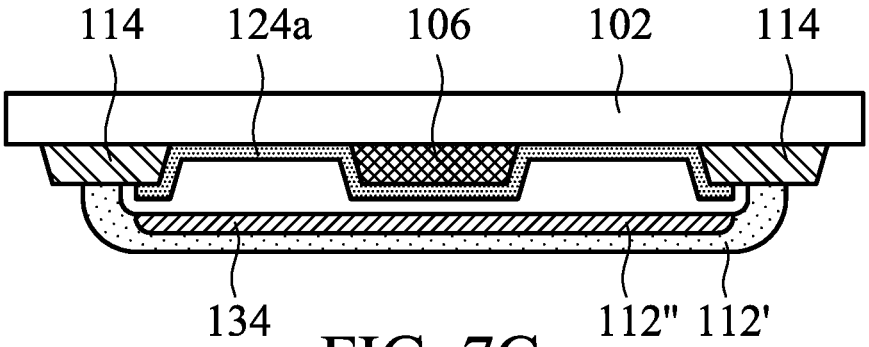
Figure 7D:
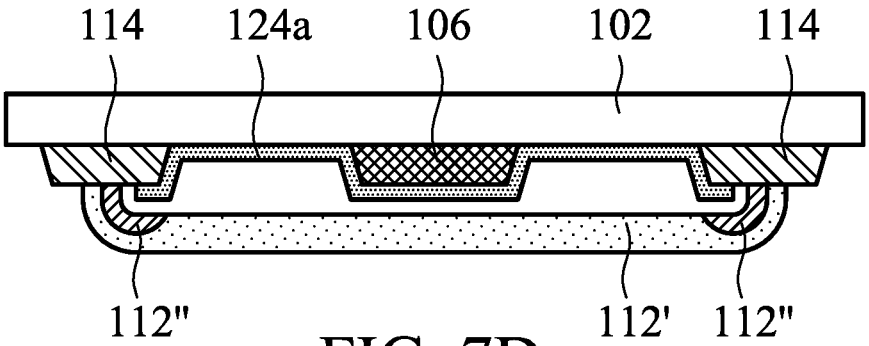

In some embodiment, a portion of the membrane 112 may have a single layered structure while another portion of the membrane 112 may have a multilayered structure. Referring to FIG. 7C, in some embodiments, the portion of the membrane 112 near the position where the membrane 112 connects to the first pad 114 is formed of single layer (i.e. the first layer 112') while the other portion is formed of two layers. In other words, the second layer 112" is not in contact with the first pads 114. In some embodiments, the second layer 112" may be partially embedded in the first layer 112'. On the other hands, referring to FIG. 7D, the portion of the membrane 112 near the position where the membrane 112 connects to the first pad 114 is formed of two layers (i.e. the first layer 112' and the second layer 112") while the other portion is formed of single layer. In such embodiments, both the first layer 112' and the second layer 112" are in contact with the first pads 114.

To summarize the above, the present disclosure provides an antenna device. The antenna device includes the antenna units that employ the structure of microelectromechanical system. In addition, the antenna units are arranged in a manner that the electromagnetic wave generated by the antenna device may be substantially circular-polarized. Thus, the signal quality provided by the antenna device may be improved. With such a configuration, the antenna device may be more energy-saving as well.

Although some embodiments of the present disclosure and their advantages have been described in detail, it should be understood that various changes, substitutions and alterations can be made herein without departing from the spirit and scope of the disclosure as defined by the appended claims.

What is claimed is:

1. An antenna device, comprising:

a first antenna pair, the first antenna pair comprising:

a first antenna unit comprising a first electrode and a first membrane extending in a first longitudinal direction and disposed across the first electrode, wherein the first membrane comprises at least one hole that does not overlap the first electrode; and a second antenna unit arranged juxtaposedly to the first antenna unit, the second antenna unit comprising a second membrane extending in a second longitudinal direction;

wherein an angle between the first longitudinal direction and the second longitudinal direction is in a range from 75 to 105 degrees.

2. The antenna device as claimed in claim 1, further comprising:

a second antenna pair adjacent to the first antenna pair, the second antenna pair comprising a third antenna unit, the third antenna unit comprising a third membrane extending in a third longitudinal direction;

wherein an angle between the third longitudinal direction and the first longitudinal direction is in a range from 0 to 15 degrees.

3. The antenna device as claimed in claim 1, comprising a first driving element and a second driving element, wherein the first driving element is electrically connected to the first membrane, the second driving element is electrically connected to the second membrane.

4. The antenna device as claimed in claim 3, further comprising a third driving element and a second antenna pair adjacent to the first antenna pair, the second antenna pair comprising a third antenna unit, the third antenna unit comprising a third membrane extending in a third longitudinal direction, and the third driving element electrically connected to the third membrane, wherein the first driving element and the third driving element are activated sequentially.

5. The antenna device as claimed in claim 3, wherein the first antenna unit further comprises a pad, and the first membrane is electrically connected to the first driving element through the pad.

6. The antenna device as claimed in claim 5, wherein a thickness of the pad is greater than a thickness of the first membrane.

7. The antenna device as claimed in claim 1, further comprising a filling material disposed in the first antenna unit and in contact with the first membrane.

8. The antenna device as claimed in claim 1, wherein the first membrane is a multi-layered structure comprising an insulating layer and a conductive layer.

9. The antenna device as claimed in claim 1, wherein the first membrane comprises a first portion and a second portion, the first portion is farther away from the pad than the second portion, and the first portion overlaps the first electrode.

10. The antenna device as claimed in claim 9, wherein a thickness of the second portion is greater than a thickness of the first portion.

11. The antenna device as claimed in claim 9, wherein the first antenna unit further comprises a second electrode disposed opposite the first electrode.

12. The antenna device as claimed in claim 1, further comprising an electrostatic discharge circuit electrically connected to the first membrane.

13. An antenna device, comprising:

a plurality of first antenna pairs, each of the plurality of first antenna pairs comprising:

a first antenna unit comprising a first electrode and a first membrane extending in a first longitudinal direction and disposed across the first electrode, wherein the first membrane comprises at least one hole that does not overlap the first electrode; and a second antenna unit arranged juxtaposedly to the first antenna unit, the second antenna unit comprising a second membrane extending in a second longitudinal direction; and a waveguide disposed at one side of the plurality of first antenna pairs, wherein an angle between the first longitudinal direction and the second longitudinal direction is in a range from 75 to 105 degrees.

14. The antenna device as claimed in claim 13, wherein a feed wave provided by the waveguide travels along a fourth longitudinal direction, and an angle between the first longitudinal direction and the fourth longitudinal direction is in a range from 30 to 60 degrees.

15. The antenna device as claimed in claim 13, wherein the first membrane is disposed between the first electrode and the waveguide.

16. The antenna device as claimed in claim 13, wherein the first antenna unit further comprises a second electrode, and the first membrane is disposed between the first electrode and the second electrode.

17. The antenna device as claimed in claim 16, wherein the second electrode comprises a slot and the first membrane overlaps the slot.

18. The antenna device as claimed in claim 17, wherein the slot extends in a fifth longitudinal direction, wherein an angle between the fifth longitudinal direction and the first longitudinal direction is in a range from 0 to 15 degrees.

* * * * *